US010464111B2

(12) United States Patent
Champion et al.

(10) Patent No.: US 10,464,111 B2
(45) Date of Patent: Nov. 5, 2019

(54) METHOD OF FORMING TAILORED CAST BLANKS

(71) Applicant: Primetals Technologies Austria GmbH, Linz (AT)

(72) Inventors: Nicholas Champion, Sheffield (GB); Mark Chatterton, Doncaster (GB); Andrew Harvey, Retford (GB); Michael Steeper, Sheffield (GB)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 96 days.

(21) Appl. No.: 15/116,797

(22) PCT Filed: Dec. 8, 2014

(86) PCT No.: PCT/EP2014/076819
§ 371 (c)(1),
(2) Date: Aug. 4, 2016

(87) PCT Pub. No.: WO2015/117696
PCT Pub. Date: Aug. 13, 2015

(65) Prior Publication Data

US 2016/0375473 A1 Dec. 29, 2016

(30) Foreign Application Priority Data

Feb. 7, 2014 (GB) ..... 1402072.1

(51) Int. Cl.
*B22D 11/00* (2006.01)
*B22D 11/01* (2006.01)
(Continued)

(52) U.S. Cl.
CPC ..... *B21B 1/463* (2013.01); *B22D 11/009* (2013.01); *B22D 11/015* (2013.01); *B22D 11/05* (2013.01);
(Continued)

(58) Field of Classification Search
CPC ..... B22D 11/00; B22D 11/009; B22D 11/01; B22D 11/015; B22D 11/05; B22D 11/06;
(Continued)

(56) References Cited

U.S. PATENT DOCUMENTS 4,010,793 A 3/1977 Takemura et al.
4,702,303 A 10/1987 Monheim et al. ..... 164/491
(Continued)

FOREIGN PATENT DOCUMENTS

AU 703992 B2 3/1997
CN 85108654 A 9/1986
(Continued)

OTHER PUBLICATIONS

Office Action dated Apr. 1, 2017 issued in corresponding Chinese Patent Application No. 201480075033.0 with English translation.
(Continued)

*Primary Examiner* — Kevin P Kerns
(74) *Attorney, Agent, or Firm* — Ostrolenk Faber LLP

(57) ABSTRACT

A method of forming tailored cast blanks including determining at least one of a thickness pattern or profile pattern for a blank, generating a layout for a series of blanks having the determined thickness or profile pattern and casting a strip in accordance with the layout, including varying the caster width during casting of the strip.

13 Claims, 3 Drawing Sheets

(51) Int. Cl.

| | |
|---|---|
| ***B22D 11/05*** | (2006.01) |
| ***B22D 11/06*** | (2006.01) |
| ***B22D 11/11*** | (2006.01) |
| ***B22D 11/12*** | (2006.01) |
| ***B21B 1/46*** | (2006.01) |
| ***B22D 11/115*** | (2006.01) |

(52) U.S. Cl.
CPC ..... *B22D 11/0622* (2013.01); *B22D 11/115* (2013.01); *B22D 11/1206* (2013.01); *B21B 2205/02* (2013.01)

(58) Field of Classification Search
CPC ..... B22D 11/0622; B22D 11/115; B22D 11/1206; B21B 1/46; B21B 1/463; B21B 2205/02
USPC ..... 164/480, 428, 451, 452, 417, 476; 29/527.7
See application file for complete search history.

(56) References Cited

U.S. PATENT DOCUMENTS

| | | | | |
|---|---|---|---|---|
| 4,759,400 | A | 7/1988 | Bessho et al. | 164/481 |
| 5,018,569 | A | 5/1991 | Burau et al. | 164/454 |
| 6,363,997 | B1 | 4/2002 | Urlau | 164/453 |
| 6,397,924 | B1 * | 6/2002 | Fish et al. B22D 11/0622 | 164/428 |
| 6,524,408 | B1 | 2/2003 | Schmitz et al. | 148/541 |
| 9,085,323 | B2 | 7/2015 | Busch et al. | |
| 2010/0101752 | A1 | 4/2010 | Otsuka et al. | 164/480 |
| 2012/0012273 | A1 | 1/2012 | Otsuka et al. | 164/428 |
| 2013/0213599 | A1 | 8/2013 | Grüss | 164/455 |
| 2014/0008938 | A1 | 1/2014 | Busch | |

FOREIGN PATENT DOCUMENTS

| | | | |
|---|---|---|---|
| CN | 86107519 | A | 10/1987 |
| CN | 1039370 | A | 2/1990 |
| CN | 1301203 | A | 6/2001 |
| CN | 1316929 | A | 10/2001 |
| CN | 101502878 | A | 8/2009 |
| CN | 101594949 | A | 12/2009 |
| CN | 103140312 | A | 6/2013 |
| DE | 2550012 | A1 | 5/1976 |
| GB | 2023044 | A | 12/1979 |
| JP | S60130450 | A | 7/1985 |
| JP | S63-157743 | A | 6/1988 |
| JP | H0542345 | A | 2/1993 |
| JP | 7-276004 | | 10/1995 |
| JP | H07284887 | A | 10/1995 |
| JP | 2009214143 | A | 9/2009 |
| JP | 2011-67857 | A | 4/2011 |
| KR | 20120097185 | A | 9/2012 |
| WO | WO 2009095264 | A1 | 8/2009 |
| WO | WO 2012126697 | A1 | 9/2012 |

OTHER PUBLICATIONS

Japanese Office Action, dated Sep. 15, 2017, issued in corresponding Japanese Patent Application No. 2016-550522. English translation. Total 5 pages.

Merklein M. et al; "A review on tailored blanks-production, application and evaluation"; Journal of Materials Processing Technology; vol. 214; pp. 151-164; XP002737865; 2013.

Kawachi M. et al; "Shape Control of Molten Metal Puddle by Directly Imposing Electric Field in the Casting Direction and Magnetic Field between Rolls in Twin Roll Process"; Tetsu to Hagane: Journal of the Iron and Steel Institute of Japan, Tokyo; vol. 78; No. 3; pp. 455-462; ISSN: 0021-1575; XP000255293; 1992.

Howard Gerber et al.:, "Twin-Roll Casting With an Electromagnetic Edge Dam"; Department of Engineering; pp. 2572-2577; 2000.

Marion Merklein et al.: "A Review on Tailored Blanks-Production, Applications and Evaluation"; Journal of Materials Processing Technology; pp. 151-164; 2014.

Hirt, Gerhard et al. "Twin-Roll Casting of Strip with Tailored Thickness Variation"; RWTH Aachen University of Technology, Institute of Metal Forming (IBF), Production Engineering vol. XIII/2 (2006), S. 91-94; 2006.

International Search Report and Written Opinion dated Apr. 9, 2015 issued in corresponding International Application No. PCT/EP2014/076819.

International Preliminary Report on Patentability dated May 11, 2016 issued in corresponding International Patent Application No. PCT/EP2014/076819.

Search Report dated Aug. 8, 2014 issued in corresponding United Kingdom patent application No. 1402072.1.

* cited by examiner

METHOD OF FORMING TAILORED CAST BLANKS

CROSS-REFERENCE TO RELATED APPLICATIONS

The present application is a 35 U.S.C. §§ 371 national phase conversion of PCT/EP2014/076819, filed Dec. 8, 2014, which claims priority of Great Britain Patent Application No. 1402072.1, filed Feb. 7, 2014, the contents of which are incorporated by reference herein. The PCT International Application was published in the English language.

TECHNICAL BACKGROUND

This invention relates to a method of forming tailored cast blanks, in particular from light metal alloys.

In the automotive industry many components are pressed from blanks. A blank is a piece of metal which has been cut to the right shape and is ready for pressing. More recently, a special type of blank, known as a tailored blank, has been used. A tailored blank is typically made from different thicknesses of metal and/or different grades of metal which are welded together. The main advantage of a tailored blank is that it can have different properties in different areas—for example high strength in one area and deep drawing properties and/or lower strength in another area. Tailored blanks can save weight and can also be cheaper than conventional blanks.

Another trend in the automotive industry is the increased use of aluminium alloys and other light metals such as magnesium alloys. Tailor welded blanks made from aluminium alloys have been used in the industry, but there are concerns about the integrity and performance of the welds and so the industry has been investigating other methods of producing tailored blanks which do not involve welding.

One of the methods for producing tailored blanks which does not involve welding is known as the tailor rolled blank. During the rolling process the roll gap is adjusted in a controlled manner which is synchronized with the speed of the strip so that the rolled strip has thickness changes which are synchronized with the size of the required blanks. When the blanks are then cut out of the rolled strip, they have different thicknesses in different areas.

One of the limitations of the original tailor rolled blank concept is that the thickness variations are only along the length of the rolled strip so that the thickness variation in the blank is only along one axis. In many cases this is sufficient, but for even more flexibility, the industry has also been looking at varying the thickness across the width. This is known as strip profile rolling, combining tailor rolling with strip profile rolling to simultaneously change the thickness of the strip in the longitudinal as well as in the width direction. Another area of active research is producing thickness and profile variations at the caster. For example, as described in "Twin-roll casting of strip with tailored thickness variation". Hirt et al. Production Engineering. Research and Development (2006) Bd.13, Nr.2, S.91-94.

JP07284887 discloses casting of a thin slab and changing the width of the thin slab during casting. The cast slab can be coiled.

JP05042345 discloses casting of a strip and weirs to facilitate width change without leakage of molten steel.

From AU-A-60787/96 a strip casting method is known wherein instead of side dams, magnets are used to generate magnetic fields which are used for change of width of the casted strip. Electromagnetic fields are generating Lorentz's forces in the molten steel so that the molten metal pool can be maintained at tops of casting rolls.

JP60130450 discloses casting of a thin slab and changing the width of the thin slab during casting.

GB 2023044A discloses adjustment of cross-sectional format in continuous casting by altering the inclination of mold side walls.

DT 2550012A1 discloses a method for changing the width of a cast strand during continuous casting by means of changing the position of one mold wall during casting.

WO 2009/095264A1 disloses a method for the production of a hot-rolled TWIP-steel strip. The method is based on conventional continuous casting of a slab and direct rolling of the cast slab.

WO 2012/126697 A1 discloses metal reinforcing sheet for a B-pillar of a vehicle body consisting of a hot-formed tailor rolled blank.

Article "A review of tailored blanks—production, applications and evaluation" from the Journal of Materials Processing Technology, 214 (2014) 151-164, Merklein et al., provides an overview on tailored blanks, their production and applications e.g. in car bodies.

SUMMARY OF THE INVENTION

In accordance with a first aspect of the present invention, a method of forming tailored cast blanks comprises determining a thickness pattern and a profile pattern for a blank; generating a layout for a series of blanks having the determined thickness and profile patterns; and casting a strip in accordance with the layout, including varying a width of the caster during casting of the strip and wherein the method further comprises varying a caster roll gap or rolling the cast strip to modify a thickness of sections of the blanks. The determining of a thickness and/or of a profile pattern for a blank followed by generating a layout includes defining instructions for the casting application.

The method varies width wise edge confinement of molten metal in the caster and hence varies the width of the resultant strip, in accordance with the chosen layout of blanks, thereby reducing wastage.

Preferably, the varying of the caster width comprises varying an effective position of an edge confinement device on at least one edge of the strip to follow an outline of the layout.

The position variation may be on both edges at the same time, on one edge, then on the other, at different times, or a combination of altering the position of both side barriers together with altering only one side barrier at a time, according to the outline shape required.

Preferably, varying the caster width comprises independently varying an effective position of an edge confinement device on both edges of the strip independently to follow an outline of the layout.

Preferably, the edge confinement device comprises one of a mechanical edge dam or an electromagnetic confinement mechanism.

Preferably, the thickness is modified along the length of the strip, or across the width of the strip to change the profile.

Preferably, the method further comprises determining a further pattern for a further blank and integrating the further pattern and the pattern in the layout for casting.

Preferably, the casting and rolling is a continuous process.

Preferably, the cast and rolled strip is formed into a coil.

Preferably, the method further comprises cutting the strip into discrete sections, each section containing at least one tailored cast blank.

In accordance with a second aspect of the present invention, a strip comprises at least one tailored cast blank with a thickness pattern and a profile pattern. The strip comprises an outline which varies on its edges in accordance with a variation in edge confinement device position across the caster width during casting and varies on its thickness.

BRIEF DESCRIPTION OF THE DRAWINGS

An example of a method of forming tailored cast blanks will now be described with reference to the accompanying drawings in which.

DESCRIPTION OF PRIOR ART

Aluminium and other light metal strips are usually produced from either thick cast slabs or ingots up to around 600 mm thick, for example from a direct chill (DC) caster, or in a twin roll caster. In general DC casters are not capable of changing the casting width during casting. The whole slab or ingot is produced with the same width. Therefore, the rolled strip has the same width for the whole length of the coil. Some twin-roll casters can change the casting width during casting. But, this is usually done in order to produce a coil having a different width from the previous coil. Within each coil the width is substantially constant. The same applies to other methods of casting such as belt casting. The cast slabs or cast strip have substantially constant width over the length of a coil.

Figure 1A:
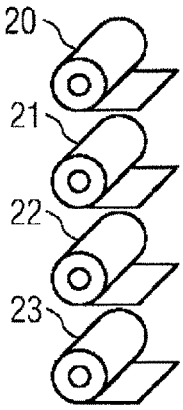
FIG 1A (PRIOR ART)
FIGS. 1A, 1B and 1C illustrate steps in a prior art process of forming tailor welded blanks.
Figure 1B:
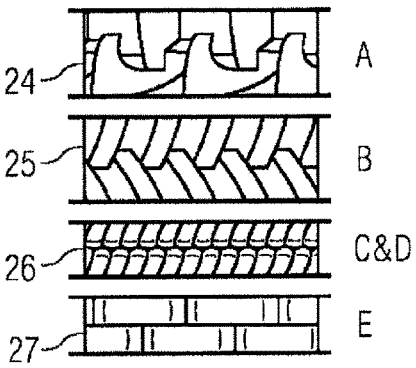
FIG 1B (PRIOR ART)
Figure 1C:
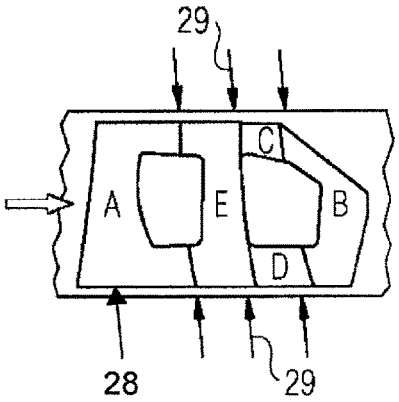
FIG 1C (PRIOR ART)

In the tailor welding process, as illustrated in FIGS. 1A, 1B and 1C, a complete door panel (FIG. 1C) for automotive use may be divided into segments A-E made from different grades and thicknesses of material, particularly metal(s), in order to optimize the strength and weight of the door panel. Another benefit of splitting the door panel up like this is that the individual segments can be arranged on the rolled strips so as to maximize the utilization of the rolled strips. From each of coils 20, 21, 22, 23 (FIG. 1A) of different grade steels, multiple copies of a respective particular segment are cut. In this example, the thicknesses are 1 mm, 2 mm, 1.5 mm and 2 mm respectively, with different segments laid out. The segments are rotated relative to their final arrangement in the door panel and laid out in a pattern which uses as much as possible of the material 24, 25, 26, 27. Then the segments A, B, C, D, E are cut from the strips. In some cases, more than one segment is cut from the same strip, as shown by parts C and D. The cost savings from this efficient use of material often outweigh the costs of the welding process, so that the complete tailored blank is actually cheaper than a conventional blank. All the parts required to make up the complete door blank 28 (FIG. 1C) are put in place and then laser welded together along the welding lines 29 before being delivered to the customer.

Figure 2:
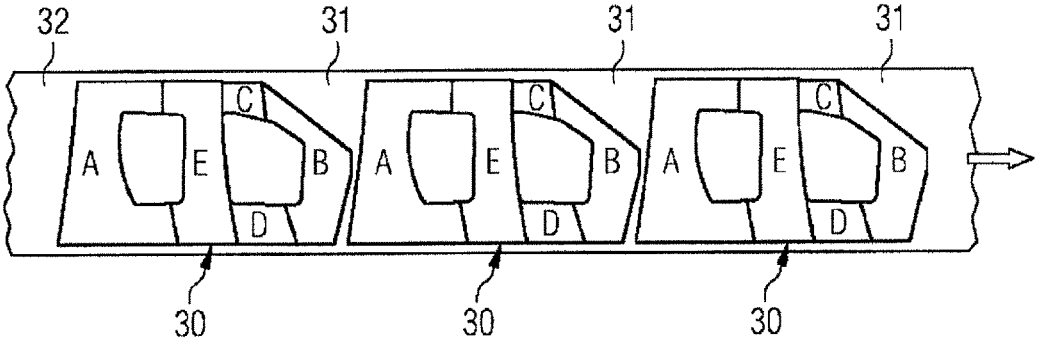
FIG 2 (PRIOR ART)
FIG. 2 illustrate the prior art process of forming tailor rolled blanks.

However, as discussed in the background section, in the case of aluminium and other light alloys used as the metal, there are concerns about the integrity and performance of the welds in tailor welded blanks. So, the industry has been looking at tailor rolled and profiled blanks instead. An example of this type of blank is illustrated in FIG. 2. A previously formed coiled strip 32 is rolled so that the sections A, B, C, D, E of blank 30 are created on the strip with required thickness for each section. But, as they are rolled from a continuous strip, they are already joined together, so no welding step is required to form the blank 30. With a tailor rolled blank, while it is possible to get different thicknesses in different areas of the blank, it is not possible to maximize the utilization of the rolled strip in the same way as the tailor welded blank because of rolling the blank as one piece. As a result, with a tailor rolled or 3-D profiled blank there may be significant waste material 31.

Description of Embodiments

In order to reduce this wastage, while still benefiting from the absence of welds, the present invention provides a method of forming a blank, whereby more efficient use of the strip can be made by adapting the process by which the strip is formed.

Current practices for forming metal strip for rolling include casting discrete slabs of metal which must be reheated before rolling to the correct thickness, casting a strand of metal which is rolled directly off the caster without being cut to length, or casting a strip of constant width and thickness which has to be cut and pressed into shape by end users, resulting in yield and energy losses due to the rolled product being only vaguely similar in size and shape to the end product. Normal practice for metals cast using twin roll casters is to cast at the same width from the beginning of the cast to the end of the cast.

Figure 3:
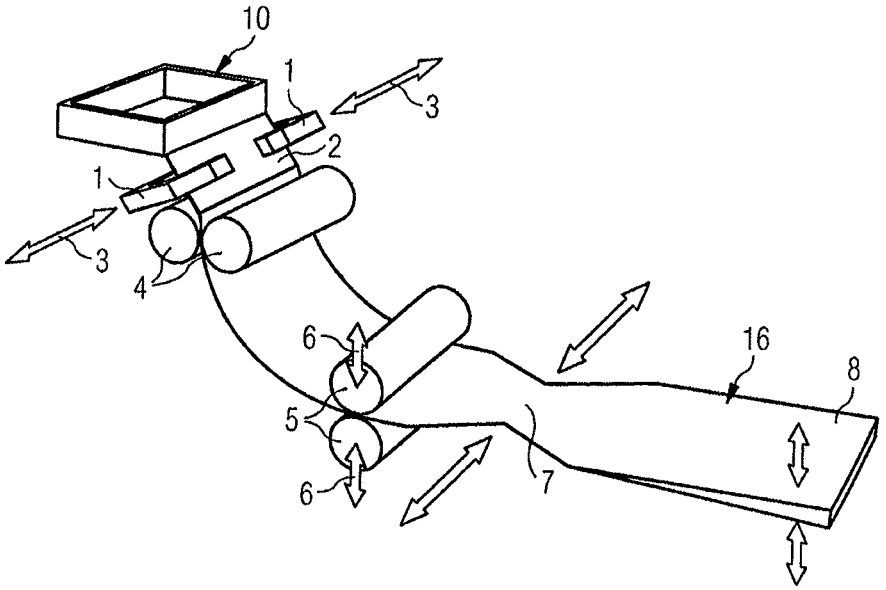
FIG. 3 illustrates an apparatus for forming tailor cast blanks in accordance with the present invention.

FIG. 3 illustrates apparatus for carrying out the method of the present invention. Molten metal from the caster tundish 10 passes via caster feeder tip 2 to caster rolls 4 to form a strip 16. At each side of the caster feeder tip 2 are electromagnets 1 which act magnetically to confine the molten metal in the width direction.

Figure 3A:
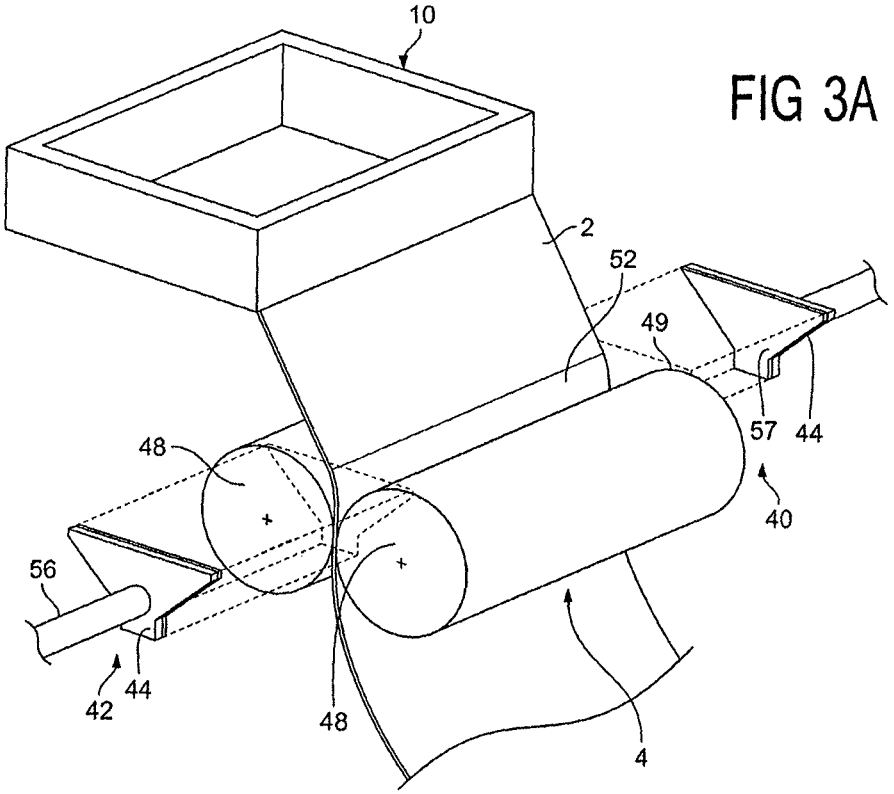
FIG. 3A illustrates an alternative.

As an alternative, an edge confinement device, such as an edge dam at each side edge of each caster roll is adjustable during casting to profile the edges of the strip. See FIG. 3A. Each edge dam 40, 42 comprises a plate 44 which is supported axially outward of the caster rolls 4 and is movable from being spaced out from the axial edges or ends 48 of the caster rolls, as shown, inward to contact the respective ends 48, 49 of the caster rolls, thereby enclosing and forming a bath vessel 52 for a bath of liquid steel to be solidified between the cooled and rotating caster rolls 4. The liquid steel enters the bath vessel 52 between the caster rolls 4 and forms a melt bath there. That bath is delimited in the direction of the axes of the caster rolls by the edge dams. The positions of the edge dams can be adjusted parallel to the axes of the caster rolls by adjusting mechanisms 56 connected with the edge dams, supporting the edge dams and moving them axially. The plates 44 of the edge dams may be shaped as shown to enclose the bath 52 and enable the casting rolls to be supported. The axially inward surface 57 of each of the edge dams may have a plate of heat resistant material on it which is shaped to contact the lateral edge surfaces 48, 49 of the caster rolls on each side to seal the liquid steel in the melt bath. Other edge confinement devices may be used.

During the casting of the strip, by moving one or both of the electromagnets 1 that are situated on one or both sides of the caster feeder tip 2, transversely to the direction of cast, as indicated by the arrows 3, it is possible to modify the flow of liquid metal into the caster rolls 4 and as a consequence modify the final width of the cast strip in certain regions 7. Varying the extent to which the molten metal is constrained in the width direction before it exits the caster results in the width of the cast strip so formed varying along the length of the strip. Cast strip 16 may have a varying width along the length that is directly linked to the change in profile of the final product. This variation in caster width during casting reduces wastage. The caster width may be varied to follow the outline of the blanks being formed in the strip.

In addition, thickness modification may be made either by casting different strip thicknesses or by close coupling a rolling mill stand with the caster. The strip passes through a roll gap between caster rolls, or rolling mill stand rolls. Moving the caster rolls 4 or the rolling mill stand rolls 5 in a direction 6, perpendicular to the direction of cast, to increase or decrease a roll gap, allows the strip thickness 8 to be modified. Thus, the size and shape of the cast and rolled strip may be made as close to the end product as possible by controlling the transverse and perpendicular movements and constraints as required. This has particular relevance to products in the automotive industry, but may be useful in other industries, such as aerospace.

Figure 4:
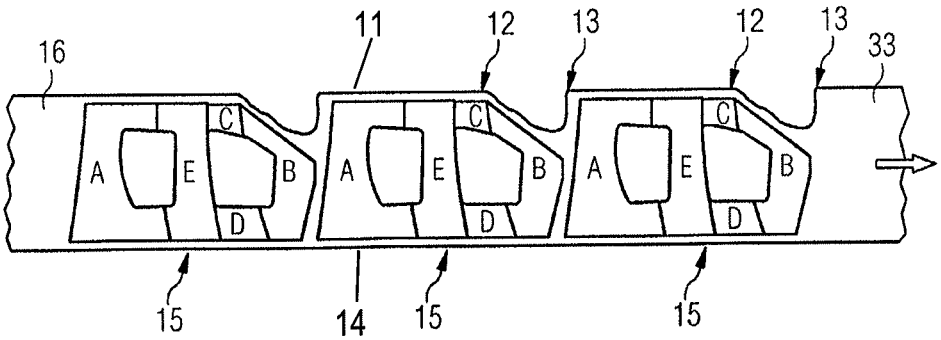
FIG. 4 shows a first example of a cast strip formed using the method of the present invention.

FIG. 4 illustrates an example of tailored cast blanks manufactured in accordance with the present invention in which the width changes on only one of the edges 11, 14 of the cast strip 33 by re-positioning the electromagnet 1 on one side only at a position 12 along the length, after an initial section of the blank 15 has been formed and for only part of the length of strip corresponding to each blank. At the end of the first blank, the electromagnet is moved back to its starting position 13 for a period during which the edges of the strip are parallel again.

The arrangement of the blanks illustrated in FIG. 4 is not ideal from the point of view of the rate of change of caster width. All of the width change takes place on one side, whereas it is preferable to keep the center of the rolled strip as close to the centerline of the mill as possible, in order to minimise steering problems. Depending on the size of the blank required and the maximum strip width, it is possible to re-arrange the blanks to achieve much lower rates of caster width change and to keep the center of the strip closer to the caster and mill centerline.

Figure 5:
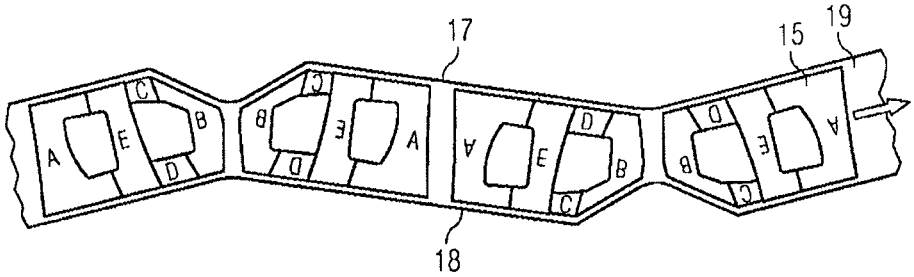
FIG. 5 shows a second example of a cast strip formed using the method of the present invention; and, FIG. 6 shows a further embodiment of an apparatus for forming tailor cast blanks according to the present invention.

One possible arrangement is illustrated in FIG. 5. For these blanks which may have been tailor cast/tailor rolled/3-D profiled the regions A, B, C, D, E are regions of different thickness within the one blank 15. In this example, the electromagnets are moved independently of one another in order to follow the profile of the blanks and also to keep the strip as closely as possible centered about the caster and mill centerline. Thus, the variation may be on both edges at the same time, on one edge, then on the other, at different times, or a combination of altering the position of both electromagnets together and altering only one at a time, whereby the effective edge created by the confinement of the molten metal is varied. The edges 17, 18 of the strip may be substantially parallel with one another in some places, but they are no longer substantially parallel to the centerline of the strip rolling mill. The overall cast rolled strip is however more closely centered with respect to the caster and mill centerline than the example of FIG. 4.

After casting and rolling, the strip may be coiled before dispatch to the end user, or the strip may be cut into discrete lengths according to the requirements of the final product. The process of casting and rolling may be linked to improve energy savings and improve production rates of coils that are then sent on to customers to be cut into shorter lengths before further intermediate steps of rolling, stamping and cropping. Changes of the width and thickness and cutting to length of the product may be accurately controlled and synchronized by an automation system. Directly modifying the cast width and thickness in the cast strip at the initial casting and hot rolling stage enables the strip dimensions to more closely match those of the final product, so reducing wastage. The width changes are rapid and may be carried out frequently to achieve the variation in width required to significantly reduce the amount of material wasted, or recycled, when the end product is produced. Modifying the width and or thickness of the strip as it is formed reduces the amount of rework required to be made on the strip to complete its transformation into the end product. Continuously casting and rolling metal strip into tailored cast blanks by varying the strip width and thickness during the process eliminates the need to reheat the product before rolling to the correct thickness, as well as reducing yield loss by creating a product as near to the finished dimensions as possible.

A further feature of the present invention is to include a blank for a different component in a part of the strip not otherwise being used, subject to the size or thickness or grade required being sufficiently similar. Another option is to use profiled rolls in the caster and rolling mill to modify the thickness of the strip across the width of the strip, as well as along its length.

Figure 6:
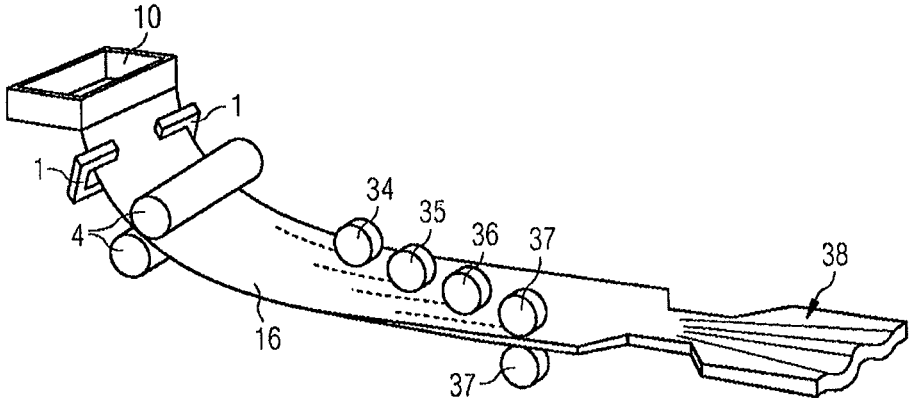

In a further embodiment, illustrated in FIG. 6, instead of a single profiled roll, a plurality of rolls, offset across the width of the strip may be used. For clarity, the pairs of rolls are illustrated as being offset in the direction of travel of the cast, but they need not be. With suitable supports the pairs of rolls may be located adjacent to one another on the same line parallel to the caster roller axis, or alternate between two lines parallel to the caster roller axis. The roll gaps set for each pair are chosen according to the thickness required at that transverse location across the strip. The cast strip 16 exits the caster rollers 4 and passes through the, or each, pair of rolls of the rolling mill stand according to whether or not the pairs are offset in the direction of the cast. The first pair of rolls 34, positioned towards one edge of the strip, have a different roll gap and hence produce a different thickness in the rolled product to an adjacent pair of rolls, although across the width, if the end product so requires, there may be more than one set of non-adjacent rolls set to the same roll gap. The example shown has another three pairs of rolls 35, 36, 37 each offset from one another in the transverse direction relative to the first pair of rolls 34, but the number of pairs of rolls actually used will depend upon the requirements of the end product. After passing through all of the pairs of rolls, the final strip 38 has width which varies in accordance with the variation as applied by the casting process and a thickness profile modified by the subsequent rolling process. The width of the strip, the thickness of the strip and the cross-sectional profile may be infinitely varied along the length to suit the finished blank requirement.

The examples have been described with reference to the use of electromagnets to constrain the molten metal and so modify the width of the cast strip at different positions along its length, as this is the most flexible way to automate such a method. However, for a relatively small amount of change of width, or a change which is not particularly rapid, mechanical end dams may be used with the caster and moved by actuators, under the control of a controller programmed for the required outline.

The invention claimed is:

1. A method of forming tailored cast blanks, the method comprising:

determining a thickness pattern and profile pattern for a tailored cast blank;

generating a layout for a series of tailored cast blanks having the determined thickness and profile patterns;

casting a strip in accordance with the layout of the tailored cast blanks, including the steps of:

varying a width of the strip between lateral edges of the strip during the casting of the strip; and during the casting in a caster including rolls at opposite surfaces of the strip, varying a caster roll gap between the rolls at opposite surfaces of the strip by moving the rolls in a direction perpendicular to a direction of the strip and then rolling the strip to modify respective thicknesses of sections of tailored cast blanks which are formed from the strip being rolled; and forming the tailored cast blanks from the strip, wherein the varying of the width of the strip is performed without moving the rolls and a width of the tailored cast blanks varies along at least a part of the length of at least one of the tailored cast blanks.

2. The method according to claim 1, wherein the varying of the width of the strip comprises varying an effective position of an edge confinement device on at least one edge of the strip to follow an outline of the layout.

3. The method according to claim 2, wherein the edge confinement device comprises one of a mechanical edge dam or an electromagnetic confinement mechanism.

4. The method according to claim 1, wherein the varying of the width of the strip comprises independently varying an effective position of a respective independent edge confinement device at both edges of the strip to follow an outline of the layout.

5. The method according to claim 1, further comprising modifying a thickness of the strip along the length of the strip or across the width of the strip to change the profile.

6. The method according to claim 1, further comprising:

determining a further pattern for a further tailored cast blank, and integrating the further pattern and the thickness pattern and the profile pattern in the layout for the series of tailored cast blanks.

7. The method according to claim 1, wherein the casting and the rolling are continuous processes.

8. The method according to claim 1, further comprising forming the tailored cast blanks into a coil.

9. The method according to claim 1, further comprising cutting the tailored cast blanks into discrete sections, wherein each section contains at least one tailored cast blank.

10. The method according to claim 1, further comprising providing profiled regions of metal to the tailored cast blank, the regions having different respective thicknesses than a thickness of the strip prior to the casting.

11. The method according to claim 1, further comprising providing a plurality of pairs of the caster rolls, the rolls of each of the pairs being at the opposite surfaces of the strip, and each of the pairs of the caster rolls being at a respective location across the width of the strip and defining a respective caster roll gap, the caster roll gap between a pair of the caster rolls being adjustable with respect to the caster roll gap between another of the pairs of caster rolls, whereby the strip rolled may have a layout of different thicknesses across the strip.

12. The method according to claim 1, wherein the varying of the width of the strip is performed by electromagnets.

13. The method according to claim 1, wherein the varying of the width of the strip is performed by edge dams.

* * * * *